US005183976A

United States Patent [19]

Plemons, Jr.

[11] Patent Number: 5,183,976

[45] Date of Patent: Feb. 2, 1993

[54] ADJUSTABLE SOUND ATTENUATING DEVICE

[76] Inventor: R. J. Plemons, Jr., 1126 Rockledge Rd., Attalla, Ala. 35954

[21] Appl. No.: 798,524

[22] Filed: Nov. 26, 1991

[51] Int. Cl.[5] ..... F01N 1/08

[52] U.S. Cl. ..... 181/264; 181/266; 181/268; 181/272; 181/273; 181/276

[58] Field of Search ..... 181/264, 265, 266, 268, 181/269, 270, 272, 273, 275, 276, 281, 282, 247, 248, 249, 250, 251, 257

[56] References Cited

U.S. PATENT DOCUMENTS

| | | | |
|---|---|---|---|
| 2,828,830 | 4/1958 | Clark | 181/264 |
| 3,337,939 | 8/1967 | Parkinson | 181/282 |
| 3,412,825 | 11/1968 | Hall | 181/247 |
| 4,325,459 | 4/1982 | Martin | 181/248 |
| 4,416,350 | 11/1983 | Hayashi | 181/272 |
| 5,025,890 | 6/1991 | Hisashige et al. | 181/272 |

*Primary Examiner*—Michael L. Gellner
*Assistant Examiner*—Khanh Dang
*Attorney, Agent, or Firm*—Phillips & Beumer

[57] ABSTRACT

An adjustable sound attenuating device comprised of an elongated outer main shell of a predetermined diameter, with an inlet coupling and an outlet coupling. The device has located within the shell singular or multiple independent baffle components comprised of a solid baffle plate, a perforated baffle plate, an optional perforated baffle plug, and several chambers provided by the baffle components. The solid and perforated baffle plates have a funnel shape to provide for smooth directional flow of exhaust gases. The perforated baffle plate is pierced with a plurality of openings to allow for the flow of the exhaust gases through the chambers. The perforated baffle tube is pierced with inwardly angled louvers spaced equally around the circumference and staggered to follow a spiral path lengthwise around the perimeter of the tube for routing gases through the chambers. The optional perforated baffle plug is pierced with a plurality of partial openings and acts as a wave interference device to contribute to sound attenuation. The baffle components can be arranged in various configurations providing multiple levels of desirable and acceptable sound attenuation without the use of sound absorbing material. The elimination of sound absorging material contributing to a consistent tone throughout the life of the muffler. The use of a basic baffle component for a wide variety of applicable products results in less cost and time necessary for production. Attenuation of sound is made possible in a minimum amount of space without resulting in increased back pressure.

20 Claims, 4 Drawing Sheets

ADJUSTABLE SOUND ATTENUATING DEVICE

BACKGROUND-FIELD OF INVENTION

This invention relates to sound attenuating devices for internal combustion engines, specifically to a muffler which, depending upon the baffle arrangement, has variable levels of sound attenuating capabilities, requires no sound absorbing material to attenuate the sound, therefore maintaining the same tone throughout the life of the muffler, reduces the cost of added packings, and achieves this in a minimum amount of space therefore making it suitable to a wide variety of applications, at a low cost.

BACKGROUND-DISCUSSION OF PRIOR ART

Whereas consumers look to different designs and styles in a product to meet their demands, individuals also have different requirements as to the level of sound preferred in their exhaust systems.

Heretofore, to achieve a different level of sound between mufflers, it has been necessary to have different internal designs for different applications, or to use the addition of sound absorbent materials. While the addition of fiberglass or some other such material or packing provides for some attenuation of sound it also adds to the expense and weight of the finished product.

To achieve a lesser degree of sound, without the addition of packings, requires a different type of internal component than is needed for a muffler with a louder, but desirable, noise level. Therefore, multiple designs, different material requirements, separate tooling, and various manufacturing processes are necessary to achieve a wide range of muffler applications. The need for all of these elements results in added production costs and increased time consumption.

It is therefore desirable to create a muffler that, upon construction, uses the same basic baffle components in different configurations to achieve various acceptable and desirable levels of sound without compromising the integrity or size of the exterior shell of the muffler, and without the use of added packings. The use of the same basic baffle components to achieve different degrees of sound attenuation eliminates the need for multiple tooling and manufacturing processes and results in less time and expense necessary for production.

A large portion of sound attenuating devices for internal combustion engines rely on the addition of sound absorbing materials, such as fiberglass, steel wool or other such packings to reduce the level of noise. While the addition of these materials result in somewhat lower noise levels, the effectiveness is short lived. The continuous force and excessive heat of the exhaust gases passing through the muffler cause the absorbent materials to deteriorate rapidly. This results in the packings being completely destroyed and blown from the exhaust system. This normally happens well before the expected life-span of the muffler structure is complete. Therefore, the sound attenuating ability of this dissipation type muffler is effective only for a short time and results in continually changing and progressively louder noise levels.

It is therefore desirable to produce a muffler capable of producing an acceptable level of noise, without the reliance on sound absorbent materials, which can maintain the same degree of sound throughout the life span of the muffler.

While the attenuation of sound is the primary concern of a muffler, there are other factors which must be considered.

The noise produced in an internal combustion engine is the result of the explosions occurring in the cylinders during the operation thereof. These explosions along with the heat, and high rate of movement of the existing hydrocarbon gases result in corrosive exhaust gas which must pass through the exhaust system. The combination of these elements have a damaging effect on the internal structure of a muffler.

Also contributing to the rapid deterioration of a muffler is the condensation produced by the constant change of temperature from hot to cold. In a muffler packed with sound absorbing materials, this condensation is absorbed and collects within the packings. A substantial amount of time is required for the absorbed moisture to evaporate or dry out. This results in moisture remaining within the muffler shell and promotes rust and deterioration. Also, vibration oftentimes causes the welds, or other means of attachment, of some devices with internal parts to break loose resulting in a rattling noise or the failure of the attenuating abilities.

Therefore it is desirable to construct a muffler of a non-corrosive material, with internal components of such a design as to prevent the breaking loose of parts, resist the absorption of moisture, and contribute to a more durable muffler with a longer life-span.

Another consideration of a muffler is the fact that it has a limited amount of space in which to fit on a vehicle. The ability to attenuate sound when confined to a smaller muffler, usually requires a substantial amount of internal baffling, or the addition of sound absorbing materials. The baffling in most such mufflers is designed to restrict the flow of exhaust gas in order to reduce the level of noise. This results in increased back pressure and adversely affects the performance of the engine to which it is attached. Therefore it is desirable to provide a muffler of smaller dimensions, which still has sound attenuation capabilities, and doesn't contribute to increased back pressure.

Whereas all mufflers, unless constructed of an indestructible material, eventually corrode and wear out, there is a large market for replacement mufflers. Since the original muffler on an automotive vehicle is designed specifically for that application, there results a wide variety of designs necessary to replace the muffler of each automobile. Therefore it is desirable to design a muffler capable of being used in a wide variety of applications, and at a reasonable cost.

OBJECTS AND ADVANTAGES

Accordingly, several objects and advantages of my invention are:

1. To provide a device capable of sound attenuation, that is free flowing, and which doesn't contribute to increased back pressure.

2. To provide a device that uses a single basic baffle design in various configurations to achieve multiple levels of sound attenuation, thereby limiting the amount of tooling necessary to achieve a wide range of applicable products.

3. To provide a muffler capable of achieving an acceptable and desirable level of sound and with the ability to maintain the same degree of sound throughout the life span of the muffler.

4. To provide a muffler capable of reducing the noise of an internal combustion engine to an acceptable level without the use of sound absorbing materials.

5. To provide a muffler with internal components of such a design and being of such a fit as to prevent the pressure and heat of the exhaust gases passing through to cause the parts to break loose and rattle or become ineffective.

6. To provide a muffler that is suitable for application to a wide range of automotive vehicles.

7. To provide a muffler with the ability to attenuate sound within a minimum amount of space.

Further objects and advantages of my invention will become apparent from a consideration of the drawings and ensuing description thereof.

LIST OF REFERENCE NUMERALS IN DRAWINGS

Figure 1:
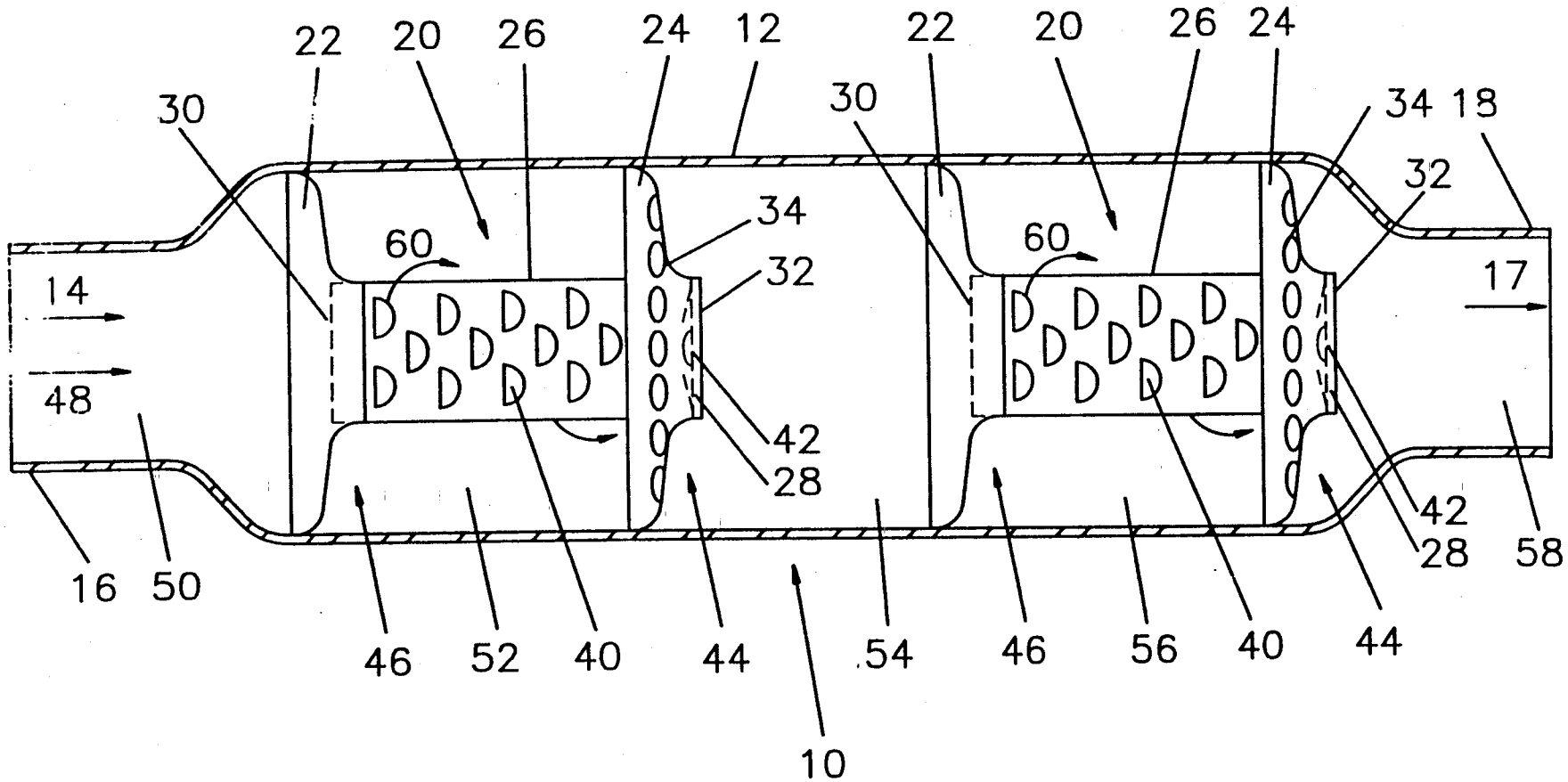
FIG. 1: is a cross sectional view of the subject invention, using multiple baffle components, including optional perforated baffle plug, and showing the flow of exhaust gas.

10- Subject of invention: Adjustable Sound Attenuating Device
12- Outer main shell
14- Inlet end
17- Outlet end
20- Baffle component
22- Solid baffle plate
24- Perforated baffle plate
26- Perforated baffle tube
28- Optional perforated baffle plug
30- Central opening solid baffle plate
32- Central opening perforated baffle plate
34- Openings perforated baffle plate
40- Baffle tube louvers
42- Optional perforated baffle plug openings
44- Outlet end of perforated baffle tube
46- Inlet end of perforated baffle tube
48- Arrow showing direction of incoming gas
50- Inlet chamber FIGS. 1, 6, 7
52, 54, 56- Baffle formed chamber FIGS. 1, 6, 7
58- Outlet chamber FIGS. 1, 6, 7
60- Arrow showing direction of gases in baffle chambers
62- Inlet chamber FIGS. 8, 9
64- Baffle formed chamber FIGS. 8, 9
66- Outlet chamber FIGS. 8, 9
16- Inlet coupling
18- Outlet coupling

DESCRIPTION OF INVENTION

Referring to FIGS. 1-3, and FIG. 6

The adjustable sound attenuating device of the subject invention is indicated generally by the numeral 10.

The device 10 is comprised of an elongated outer main shell 12 of a predetermined diameter, preferably of a metal of a relatively stiff gauge so that the shell 12 when completed is entirely self supporting, and is long lasting.

At one end 14, designated the inlet, the shell 12 is reduced somewhat in diameter to provide for the attachment, by welding, of an inlet coupling 16. The diameter of the inlet coupling 16 is preferably no greater than the diameter of the main shell 12, and as shown is slightly less in diameter so that the coupling 16 can be readily introduced into or onto the exhaust pipe of an internal combustion engine.

In a comparable way the main shell 12 at its opposite end, designated the outlet 17, is reduced somewhat in diameter to provide for the attachment, by welding, of an outlet coupling 18, which again is preferably no greater than the diameter of the main shell 12, and as shown is slightly less in diameter so that the coupling 18 can be readily introduced into or onto the tail pipe of an internal combustion engine.

Located or disposed within the main shell 12, are a plurality of baffles components, generally indicated by the numeral 20, comprised of a solid baffle plate 22, a perforated baffle plate 24, a perforated baffle tube 26, and an optional perforated baffle plug 28.

Each solid baffle plate 22, stamped preferably from an appropriate metal, is a disk of such a diameter that when pressed and formed into the final shape will have an outside diameter substantially the same as the inside diameter of the outer main shell 12. Each solid baffle plate 22 is pierced to provide a central opening 30 of such a diameter that when pressed and formed into the final shape will be substantially the same as the outer diameter of the perforated baffle tube 26.

Each solid baffle plate 22 is formed by the disk being forcefully pressed by a male die into a female forming die. The female forming die should be of such a design as to cause the outside diameter of the formed baffle plate 22 to be substantially the same as the inside diameter of the outer main shell 12. The female forming die should also provide a means for allowing the male forming die to press the central opening 30 of the baffle plate 22 into a funnel type opening with sloping sides, resulting in an insider diameter substantially the same as the outside diameter of the baffle tube 26.

Each perforated baffle plate 24, stamped preferably from an appropriate metal, is a disk of such a diameter that when pressed and formed into the final shape will have an outside diameter substantially the same as the inside diameter of the outer main shell 12. Each perforated baffle plate 24 is pierced to provide a central opening 32 of such a diameter that when pressed and formed into the final shape will be substantially the same as the outer diameter of the perforated baffle tube 26. Each perforated baffle plate 24 is also pierced with a plurality of openings 34, and the like (FIG. 3) being of equal diameter and spaced an equal distance apart, surrounding the central opening 32.

The perforated baffle plate 24 is formed by the disk being forcefully pressed by the same male die into the same female forming die as for the solid baffle plate 22. The completed form of the perforated baffle plate 24 is of the same dimensions as the solid baffle plate 22 and also provides a funnel type central opening 32.

The use of the same male and female forming dies to shape different parts of the internal baffle component 20 contributes to multipurpose manufacturing tools and results in less production time and expense.

Figure 2:
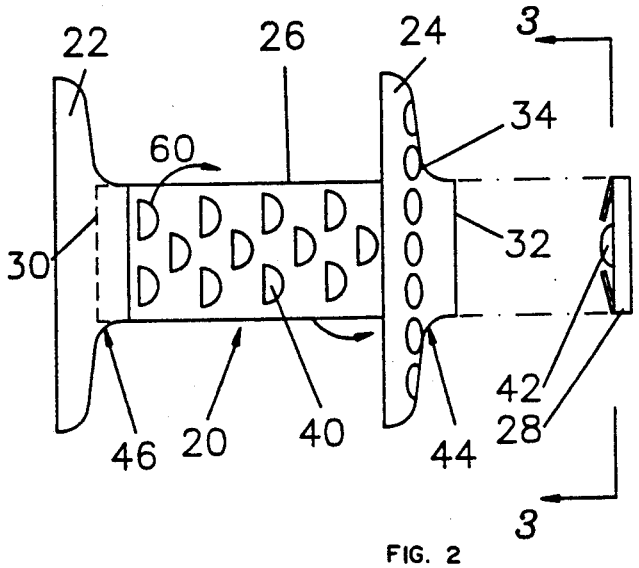
FIG. 2: a view of baffle component 20 as shown in FIGS. 1 and 6, showing optional perforated baffle plug.
Figure 3:
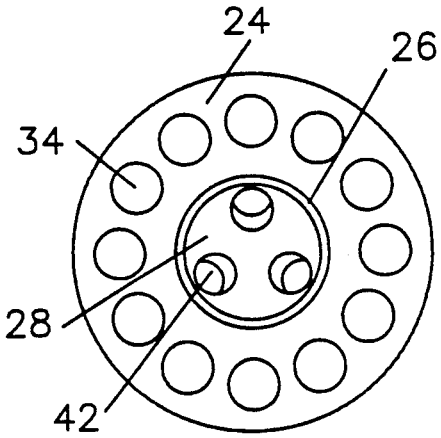
FIG. 3: an end view of baffle component 20, including optional perforated baffle plug, as taken along the lines 3—3 of FIG. 2.
Figure 4:
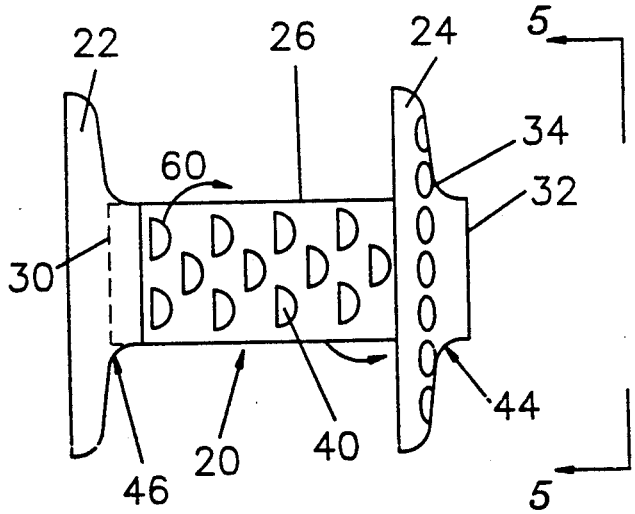
FIG. 4: an enlarged view of the baffle component 20 as shown in FIGS. 7 and 9, omitting the optional perforated baffle plug.
Figure 5:
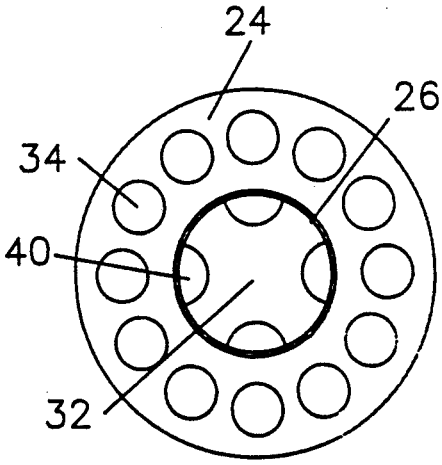
FIG. 5: an end view of the baffle component 20 omitting optional perforated baffle plug, as taken along the lines 5—5 of FIG. 4.

FIG. 2: The perforated baffle tube 26 is of an elongated form preferably of a metal of relatively stiff gauge so as to be self supportive when positioned between two baffle plates 22 and 24. The outer diameter of the perforated baffle tube 26 is substantially less in diameter than the main outer shell 12 and approximately equal to the diameter of the central openings 30 and 32 of baffle plates 22 and 24 respectively. The perforated baffle tube 26 is pierced with a multitude of partial openings of louvers 40 of equal size, which are spaced around the circumference equally from one another. The louvers are separated longitudinally a predetermined amount of space and are situated or staggered so as to follow a spiral or circular path lengthwise around the perimeter of the baffle tube. The louvers 40 are forced inward at a predetermined angle and face the inlet end 46 of the perforated baffle tube 26. The louvers 40 serve to route the gases through chambers while forming a static cleaning buffer to eliminate hydrocarbon deposits or buildup.

The optional perforated baffle plug 28, stamped preferably from an appropriate metal, is a disk of such a diameter that when pressed and formed into the final shape will have an outside diameter substantially the same as the inside diameter of the perforated baffle tube 26. The optional perforated baffle plug 28 is pierced with a plurality of partial openings or louvers 42 of the same size and spaced an equal distance apart. The louvers 42 are forced outward at a predetermined angle and face the center of the baffle plug 28.

The baffle component 20 as shown in FIG. 2 is constructed by positioning the optional perforated baffle plug 28 into the outlet end 44 of the perforated baffle tube 26, with the outwardly forced openings 42 of the plug 28 facing toward the inlet end 46 of the perforated baffle tube 26. The plug 28 must then be forcefully pressed into the baffle tube 26 so that the outer edge of the plug 28 is even with the outlet end 44 of the baffle tube 26. This provides for a close, tight fit that will withstand the pressure of the gases passing through the baffle component 20 within the completed muffler. The plug 28 is then secured to the baffle tube by welding or the like.

The perforated baffle plate 24 is then positioned on the outlet end 44 of the baffle tube 26 with the backside of the plate 24 facing the inlet end 46 of the baffle tube 26. The sloped sides of the central opening 32 provide a directional funnel toward the outlet end 44 of the baffle tube 26. The baffle plate 24 must then be forcefully pressed onto the baffle tube so that the outer edge of the central opening 32 of the baffle plate 24 is even with the outlet end 44 of the baffle tube 26. The baffle plate 24 is then secured to the baffle tube 26 by welding or the like.

The solid baffle plate 22 is then positioned on the inlet end 46 of the baffle tube 26 with the backside of the plate 22 facing the inlet end 46 of the baffle tube 26. The sloped sides of the central opening 30 provide a directional funnel toward the outlet end 44 of the baffle tube 26. The baffle plate 22 must then be forcefully pressed onto the baffle tube 26 so that the outer edge of the baffle tube 26 is a substantial amount into the central opening 30 of the baffle plate 22 so as to provide a stable, tight fit. The baffle plate 22 is then secured to the baffle tube 26 by welding or the like.

Figure 6:
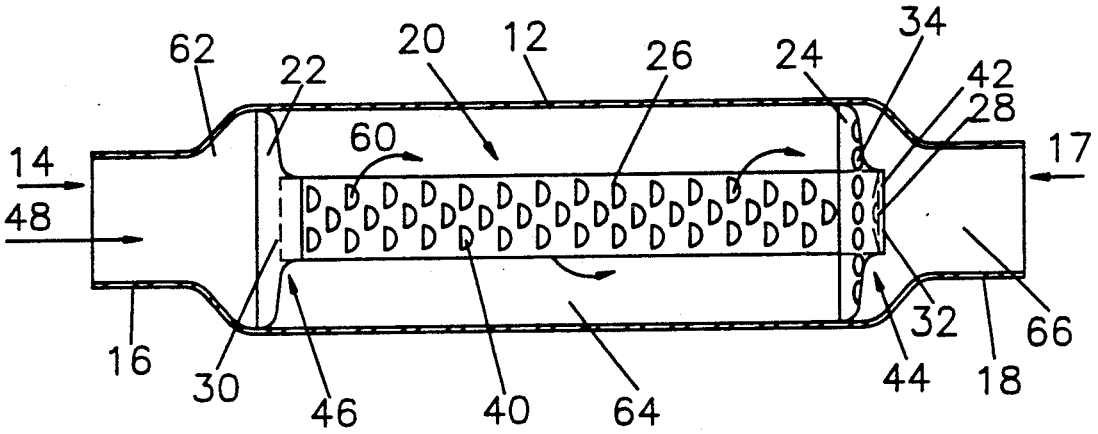
FIG. 6: a cross sectional view of the subject invention as shown in FIG. 1.

The complete baffle components 20 are then individually situated within the outer shell 12 separate and distinct from each other and spaced substantially apart in an axial direction as shown in FIG. 1, and FIG. 6. The baffle components 20 must be forcefully pressed into the outer main shell 12. The baffle components 20 may or may not be secured to the main shell 12 by welding or the like. A press fit is most often efficient since the outer diameter of baffle plates 22 and 24 are substantially the same as the inner diameter of the main shell 12.

The insertion of the baffle components 20 provide for several chambers 50, 52, 54, 56, and 58 whose functions will be evident from the ensuing description of the operation of the subject invention.

It is customary during assembly to mount the baffle components within the outer shell 12 and then to reduce the ends before attachment, by welding, of the inlet coupling 16, and the outlet coupling 18.

When the construction of the muffler is complete there results a tightly assembled structure resistant to high temperature distortion and able to withstand a high rate of pressure exertion without breaking loose, or becoming disassembled.

OPERATION OF INVENTION

Referring to FIG. 6

FIG. 6 represents a cross sectional view of the subject invention, with multiple baffle components including optional perforated baffle plug 28 and showing the flow path of exhaust gas as it passes through the muffler.

In operation, the adjustable sound attenuating device 10 of FIG. 1 and 6 is attached to the exhaust system of an internal combustion engine with the exhaust moving in the direction of arrow 48 through the inlet coupling 16. The solid baffle plate 22 extends across the width and breadth of the outer main shell 12, except for central opening 30, and is further formed to be of such a fit with the casing walls as to allow for no escaping of exhaust gases. Thus all of the exhaust gases are forced to converge in chamber 50 around the sloping back side of the cup shaped solid baffle plate 22, and are funnelled in the direction of the central opening 30, to enter the inlet end 46 of perforated baffle tube 26. A measure of the gases travel along the gas flow path provided by the perforated baffle tube 26 until striking the optional perforated baffle plug 28. While a portion of these gases continue their forward momentum and pass through the partial openings 42 of the plug 28 into the third chamber 54, part of the gases are deflected back into the baffle tube 26 and meet the gases newly entering through central opening 30.

While the perforated baffle plug 28 serves to perform wave interference duties and therefore contribute to sound attenuation, one of the main functions of perforated baffle plug 28 is to make sure, that despite any resistance to flow in the remainder of the muffler, there is a straight path through the muffler from inlet coupling 16 to the outlet coupling 18 as provided by the baffle plug openings 42. Thus at no time can the pressure within the muffler rise unduly. The amount of exhaust traveling through openings 42 is relatively small.

While a portion of the gases, upon entering central opening 30, travel down the gas flow path provided by the baffle tube 26, most of the gases exit out of the baffle tube 26 through the inwardly formed baffle tube openings or louvers 40, and expand to enter baffle chamber 52. Whereas the louvers 40 are situated or staggered so as to follow a spiral or circular path lengthwise around the perimeter of the baffle tube, this induces the gas exiting through the louvers to follow a circuitous path thereby producing a swirling motion, as well as an elongated outer flow path within the baffle chamber 52, as indicated by arrow 60.

The longitudinal distance between the louvers 40 is selected to produce an outer flow path of such a length as to provide an attenuation of a first frequency of sound in the engine exhaust as the exhaust passes through the baffle chamber 52.

While the main function of the baffle tube louvers 40 is to route the gases through the chamber it also serves as a static cleaning buffer reducing hydrocarbon deposits and buildup.

The perforated baffle plate 24 extends across the width and breadth of the outer main shell 12, except for central opening 32 which is filled by the baffle tube 26, and is further formed to be of such a fit with the casing walls as to allow no escaping of exhaust gases. Therefore the gases exiting from chamber 52, and converging around the sloping back side of the baffle plate 24, must contract and flow through the plurality of openings 34, and the like, surrounding the central opening 32, to enter into chamber 54.

Here the gases converging from chamber 52, through the baffle plate 24, meet with the gases flowing through baffle plug openings 42 and collect in chamber 54.

The sound frequency of the gases swirling within the baffle chamber 52, and passing through baffle plate 24, are quite different from the frequency of gases passing through the flow path of the baffle tube 26, and plug openings 42. Therefore the baffle component when situated within a completed muffler is capable of attenuating a wide range of sound frequencies.

As the solid baffle plate 22 in the second baffle component extends across the width and breadth of the outer main shell 12, except for central opening 30, and is further formed to be of such a fit with the casing walls as to allow for no escaping of exhaust gases, the exhaust gases collecting in chamber 54 are forced to converge around the sloping back side of the cup shaped solid baffle plate 22 and are funnelled in the direction of the central opening 30 to enter the inlet end 46 of the perforated baffle tube 26 of the second baffle component 20.

The gases then flow through the second baffle component as through the first baffle component with the same route and results, and collect in chamber 58. As the sides of the outer main shell 12 on the outlet end 17 is somewhat reduced in diameter, preferably as shown with a sloping funnel shape, the exhaust gases in chamber 58 are forced to converge toward the outlet coupling 18 and exit there through.

Figure 7:
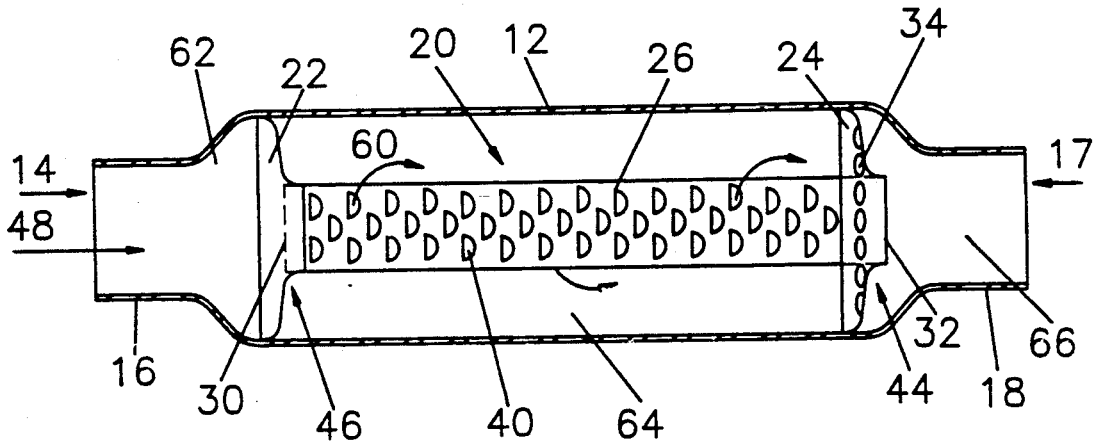
FIG. 7: a cross sectional view of an alternate form of the subject invention using multiple baffle components and omitting optional perforated baffle plug.

Referring to FIG. 7

FIG. 7 shows an alternate form of the subject invention using multiple baffle components 20, and omitting the optional perforated baffle plug 28.

In operation, the muffler of FIG. 7 works in much the same way as the subject invention of FIG. 1 and 6. The gases enter through the inlet coupling 16 and move in the direction of the arrow 48. The solid baffle plate 22 extends across the width and breadth of the main outer shell 12, except for central opening 30, and is further formed to be of such a fit with the casing walls as to allow no escaping of exhaust gases. Thus all of the exhaust gases are forced to converge in chamber 50 around the back side of the cup shaped solid baffle plate 22, and are funnelled in the direction of the central opening 30, to enter the inlet end 46 of the perforated baffle tube 26.

A measure of the gases travel along the gas flow path provided by the perforated baffle tube 26, and instead of striking the optional perforated baffle plug 28, not included, these gases continue their forward momentum and pass through the outlet end 44 of the perforated baffle tube 26, into the third chamber 54.

Because the perforated baffle plug 28 serves to perform wave interference duties and therefore contribute to sound attenuation, some of the sound attenuating ability is lost when no baffle plug 28 is included. However, this assures that despite any resistance to flow in the remainder of the muffler, there is a straight path through the muffler from inlet coupling 16 to the outlet coupling 18 as provided by the central openings 30, and 32. Thus at no time can the pressure within the muffler rise unduly. The amount of exhaust traveling through openings 30 and 32 without the perforated baffle plug 28 is substantially greater than that passing through openings 42, when baffle plug 28 is included.

Because of the reduced sound attenuating capability caused by the elimination of the perforated baffle plug 28, this provides for a muffler with a different and acceptable level of noise than that of FIG. 1 and 6, but with a very minor change and without requiring extra tooling, additional materials, or manufacturing processes.

While a portion of the gases, upon entering central opening 30, travel down the gas flow path provided by the baffle tube 26, most of the gases exit out of the baffle tube 26 through the inwardly formed baffle tube openings or louvers 40, and expand to enter baffle chamber 52. Whereas the louvers 40 are situated or staggered so as to follow a spiral or circular path lengthwise around the perimeter of the baffle tube, this induces the gas exiting through the louvers to follow a circuitous path thereby producing a swirling motion, as well as an elongated outer flow path within the baffle chamber 52, as indicated by arrow 60.

The perforated baffle plate 24 extends across the width and breadth of the outer main shell 12, except for central opening 32 which is filled with baffle tube 26, and is further formed to be of such a fit with the casing walls as to allow no escaping of exhaust gases. Therefore the gases exiting from chamber 52, and converging around the sloping back side of the baffle plate 24, must contract and flow through the plurality of openings 34, and the like, surrounding the central opening 32, to enter into chamber 54.

Here the gases converging from chamber 52, through the baffle plate 24, meet with the gases flowing through the outlet end 44 of baffle tube 26 and collect in chamber 54.

As the solid baffle plate 22 in the second baffle component extends across the width and breadth of the outer main shell 12, except for the central opening 30, and is further formed to be of such a fit with the casing walls as to allow for no escaping of exhaust gas, the exhaust gases collecting in chamber 54 are forced to converge around the sloping back side of the cup shaped solid baffle plate 22 and are funnelled in the direction of the central opening 30 to enter the inlet end 46 of the perforated baffle tube 26 of the second baffle component 20.

The gases then flow through the second baffle component as through the first baffle component with the same route and results, and collect in chamber 58. As the sides of the outer main shell 12 on the outlet end 17 is somewhat reduced in diameter, preferably as shown with a sloping funnel shape, the exhaust gas in chamber 58 is forced to converge toward the outlet coupling 18 and exit there through.

Figure 8:
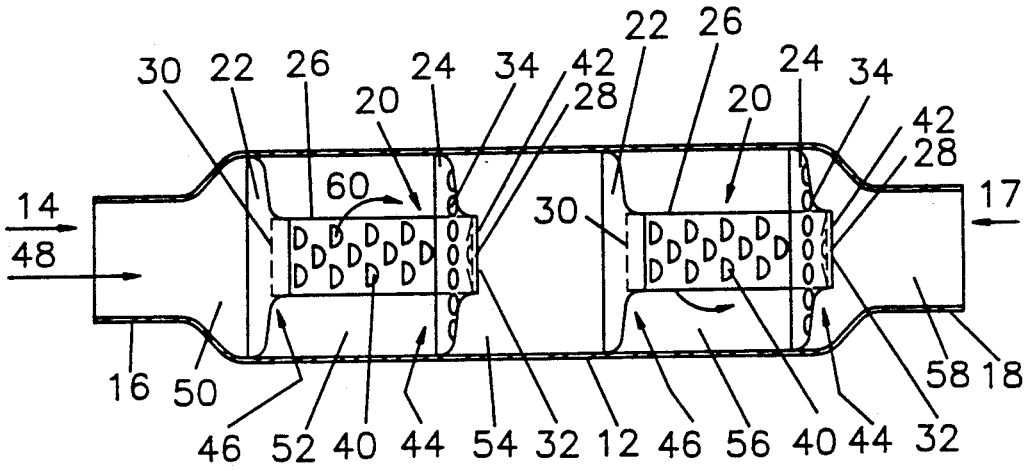
FIG. 8: a cross-sectional view of an alternate form of the subject invention, using a singular baffle component, and including optional perforated baffle plug.

Referring to FIG. 8

FIG. 8 shows an alternate form of the subject invention using a singular baffle component 20 and including optional perforated baffle plug 28.

In operation, the muffler of FIG. 8 works in much the same way as the subject invention in FIGS. 1 and 6. The exhaust gases enter through inlet coupling 16 and move in the direction of arrow 48. The solid baffle plate 22 extends across the width and breadth of the outer main shell 12, except for central opening 30, and is further formed to be of such a fit with the casing walls as to allow for no escaping gases. Thus all of the exhaust gases are forced to converge in chamber 62 around the sloping back side of the cup shaped solid baffle plate 22, and are funnelled in the direction of the central opening 30, to enter the inlet end 46 of the perforated baffle tube 26.

A measure of the gases travel along the gas flow path provided by the perforated baffle tube 26 until striking the optional perforated baffle plug 28. While a portion of these gases continue their forward momentum and pass through the partial openings 42 of the plug 28 into the outlet chamber 66, part of the gases are deflected back into baffle tube 26 and meet the gases newly entering through central opening 30.

While the perforated baffle plug 28 serves to perform wave interference duties and therefore contribute to sound attenuation, one of the main functions of baffle plug 28 is to make sure, that despite any resistance to flow in the remainder of the muffler, there is a straight path through the muffler from inlet coupling 16 to the outlet coupling 18 as provided by the baffle plug openings 42. Thus at no time can the pressure within the muffler rise unduly. The amount of exhaust traveling through openings 42 is relatively small.

While a portion of the gases, upon entering central opening 30, travel down the gas flow path provided by the baffle tube 26, most of the gases exit out of the baffle tube 26 through the inwardly formed baffle tube openings or louvers 40, and expand to enter baffle chamber 64. Whereas the louvers 40 are situated or staggered so as to follow a spiral or circular path lengthwise around the perimeter of the baffle tube, this induces the gas exiting through the louvers to follow a circuitous path thereby producing a swirling motion, as well as an elongated outer flow path within the baffle chamber 64, as indicated by arrow 60.

The preforated baffle plate 24 extends across the width and breadth of the outer main shell 12, except for central opening 32 which is filled by baffle tube 26, and is further formed to be of such a fit with the casing walls as to allow no escaping of exhaust gases. Therefore the gases exiting from chamber 64, converging around the sloping back side of the baffle plate 24, must contract to flow through the plurality of openings 34, and the like, surrounding the central opening 32, to enter into outlet chamber 66.

Here the gases converging from chamber 64, through the baffle plate 24, meet with the gases flowing through baffle plug openings 42 and collect in outlet chamber 66. As the sides of the outer main shell 12 on the outlet end 17 is somewhat reduced in diameter, preferably as shown with a sloping funnel shape, the exhaust gas in chamber 66 is forced to converge toward the outlet coupling 18 and exit there through.

The sound frequency of the gases swirling within the baffle chamber 64, and passing through baffle plate 24, are quite different from the frequency of gases passing through the flow path of the baffle tube 26, and plug openings 42. Therefore the baffle component when situated within a completed muffler is capable of attenuating a wide range of sound frequencies.

Because of the use of a single baffle component 20 as opposed to multiple baffle components, this provides for a muffler with a different and acceptable level of noise than that of FIGS. 1 and 6, as well as FIG. 7. This results from a very minor change, and requires no extra tooling, or additional manufacturing processes.

Figure 9:
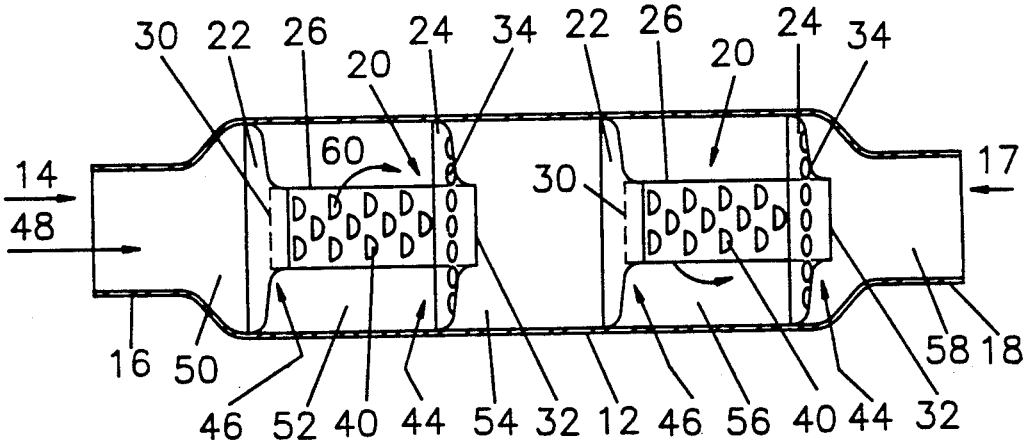
FIG. 9: a cross-sectional view of an alternate form of the subject invention, using a singular baffle component, and omitting the optional perforated baffle plug.

Referring to FIG. 9

FIG. 9 shows an alternate form of the subject invention, with a single baffle component 20 as in FIG. 8, and omitting the optional perforated baffle plug 28.

In operation, the muffler of FIG. 9 works in much the same way as the subject invention of FIGS. 1, 6, 7 and 8. The gases enter through the inlet coupling 16 and move in the direction of the arrow 48. The solid baffle plate 22 extends across the width and breadth of the outer main shell 12, except for central opening 30, and is further formed to be of such a fit with the casing walls as to allow for no escaping of exhaust gases. Thus all of the exhaust gases are forced to converge in chamber 62 around the sloping back side of the cup shaped solid baffle plate 22, and are funnelled in the direction of central opening 30, to enter the inlet end 46 of the perforated baffle tube 26.

A measure of the gases travel along the gas flow path provided by the perforated baffle tube 26, and instead of striking the optional perforated baffle plug 28, not included, these gases continue their forward momentum and pass through the outlet end 44 of the perforated baffle tube 26, into the baffle chamber 64.

Because the optional perforated baffle plug 28 serves to perform wave interference duties and therefore contribute to sound attenuation, some of the sound attenuating ability is lost when no baffle plug 28 is included. However, this assures that despite any resistance to flow in the remainder of the muffler, there is a straight path through the muffler from inlet coupling 16 to the outlet coupling 18 as provided by the central openings 30, and 32. Thus at no time can the pressure within the muffler rise unduly. The amount of exhaust traveling through openings 30 and 32 without the perforated baffle plug 28 is substantially greater than that passing through openings 42, when baffle plug 28 is included.

While a portion of the gases, upon entering central opening 30, travel down the gas flow path provided by the baffle tube 26, most of the gases exit out of the baffle tube 26 through the inwardly formed baffle tube openings or louvers 40, and expand to enter baffle chamber 64. Whereas the louvers 40 are situated or staggered so as to follow a spiral or circular path lengthwise around the perimeter of the baffle tube, this induces the gas exiting through the louvers to follow a circuitous path thereby producing a swirling motion, as well as an elongated outer flow path within the baffle chamber 64, as indicated by arrow 60.

The perforated baffle plate 24 extends across the width and breadth of the outer main shell 12, except for central opening 32 which is filled by baffle tube 26, and is further formed to be of such a fit with the casing walls as to allow no escaping of exhaust gases. Therefore the gases exiting from chamber 64, converging around the sloping back side of the baffle plate 24, must contract and flow through the plurality of openings 34, and the like surrounding the central opening 32, and enter into outlet chamber 66.

Here the gases converging from chamber 64, through the baffle plate 24, meet with the gases flowing through central opening 32 and collect in outlet chamber 66. As the sides of the outer main shell 12 on the outlet end 17 is somewhat reduced in diameter, preferably as shown with a sloping funnel shape, the exhaust gas in chamber 66 is forced to converge toward the outlet coupling 18 and exit there through.

Because of the use of a single baffle component 20, as opposed to multiple baffle components, as well the omission of the optional perforated baffle plug 28, this provides for a muffler with a different and acceptable level of noise than that of FIGS. 1 and 6, as well as FIG. 7, and FIG. 8. This results from a very minor change, and requires no extra tooling, or additional manufacturing processes.

Therefore a wide range of applicable sound attenuating devices with different but desirable levels of noise can be achieved using the same baffle components in various configurations with limited amounts of tooling necessary and without the use of sound absorbing materials, resulting in reduced expense and production time.

While the above description contains many specifications, these should not be construed as limiting the scope of the invention, but as merely providing illustrations of some of the presently preferred forms of this invention. Many other variations are possible. For example, a muffler comprised of multiple baffle components with a portion of the baffle components including optional perforated plug and the remaining omitting the plug.

Thus the scope of the invention should be determined not by the embodiments illustrated, but by the claims and their legal equivalents.

What is claimed is:

1. A muffler comprising:

an outer shell defining an elongated housing having a longitudinal axis and input and output ends;

a perforated tube disposed within said housing along said axis and having an input end and an output end spaced apart inwardly from said input and output end, respectively, of said housing, an annular chamber being defined between said tube and said housing;

a first baffle plate disposed within and transversely across said housing adjacent to the input end of said tube and defining an end chamber between the input end of said tube and said input housing end, said baffle providing a solid cover between said tube and said housing and having a central opening communicating said housing input end with said tube, whereby incoming gas will be channeled entirely into said tube; and a second baffle plate disposed transversely across said housing adjacent to the output end of said tube, said second baffle plate having a plurality of apertures extending therethrough, whereby exhaust gas may be expelled from said annular chamber around the periphery of the housing.

2. A muffler as defined in claim 1 wherein said housing is generally cylindrical.

3. A muffler as defined in claim 2 wherein perforations in said perforated tube are defined by openings adjacent to louvers disposed inwardly in a path around the circumference of the tube and having an edge adapted to receive incoming exhaust gas and channel the same into said annular chamber.

4. A muffler as defined in claim 3 wherein said louvers are separated longitudinally from one another and are arranged in a spiral pattern around the tube.

5. A muffler as defined in claim 4 wherein said second baffle plate includes a central opening having a diameter substantially equal to the outer diameter of said tube.

6. A muffler as defined in claim 4 wherein said second baffle plate includes a perforated end cap across the output end of said tube.

7. A muffler as defined in claim 2 wherein said first baffle is generally funnel-shaped with an area of reduced diameter disposed toward the output end of the housing.

8. A muffler as defined in claim 6 wherein said end cap has a plurality of perforations evenly spaced around the cap and inclined at an angle so as to face a center portion of said end cap.

9. A muffler as defined in claim 2 wherein said housing has a first section of reduced diameter adjacent to said input end and a second section of reduced diameter adjacent to said output end.

10. A muffler comprising:

an outer shell defining an elongated housing having a longitudinal axis and input and output ends;

a forward baffle assembly comprising:

a first perforated tube disposed within said housing along said axis and having an input end spaced apart inwardly from the input end of said housing, a first annular chamber being defined between said tube and said housing, a first baffle plate disposed within and transversely across said housing adjacent to the input end of said tube and defining an end chamber between the input end of said tube and said input housing end, said baffle providing a solid cover between said tube and said housing and having a central opening communicating said housing input end with said tube, whereby incoming gas will be channeled entirely into said tube, and a second baffle plate disposed transversely across said housing adjacent to the output end of said tube, said second baffle plate having a plurality of apertures extending therethrough, whereby exhaust gas may be expelled from said annular chamber around the periphery of the housing;

a chamber extending across said housing downstream of said second baffle plate; and a rearward baffle assembly comprising:

a second perforated tube disposed within said housing along said axis and having an input end and spaced apart downstream from the output end of said first perforated tube and an output end spaced apart inwardly from the output end of said housing, a second annular chamber being defined between said second tube and said housing, a third baffle plate disposed transversely across said housing adjacent to the input end of said second tube, said third baffle plate providing a solid cover between said tube and said housing and having a central opening communicating said downstream chamber with said second tube, whereby incoming gas will be channeled entirely into said second tube, and a fourth baffle plate disposed transversely across said housing adjacent to the output end of said second tube, said fourth baffle plate having a plurality of apertures extending therethrough, whereby exhaust gas may be expelled from said second annular chamber around the periphery of the housing.

11. A muffler as defined in claim 10 wherein said housing is generally cylindrical.

12. A muffler as defined in claim 11 wherein said perforations in said tubes are defined by openings adjacent to inwardly punched louvers having an edge located to receive incoming exhaust gas and channel the same into said annular chambers.

13. A muffler as defined in claim 12 wherein said louvers are spaced longitudinally from one another and arranged in a spiral pattern around each of said tubes.

14. A muffler as defined in claim 11 wherein said second and fourth baffles each have a central opening with a diameter substantially equal to the outer diameter of the adjacent tube.

15. A muffler as defined in claim 14 wherein at least one of said second and fourth baffle plates includes a perforated end cap disposed across said central opening.

16. A muffler as defined in claim 15 wherein said perforated end cap has a plurality of openings defined by louvers evenly spaced around the cap and arranged to face a center portion of the cap.

17. A muffler as defined in claim 1 including a plug disposed across said perforated tube downstream from said first baffle plate.

18. A muffler as defined in claim 15 wherein said fourth baffle includes a perforated end cap disposed across said central opening.

19. A muffler as defined in claim 18 wherein said perforated end cap of said fourth baffle has a plurality of openings defined by louvers evenly spaced around the cap and arranged to face a central point of the cap.

20. A muffler comprising:

an outer shell defining an elongated, generally cylindrical housing having input and output ends; and a plurality of baffle assemblies arranged in longitudinal sequence within said housing, whereby exhaust gas may be introduced at said housing input end, passed through each assembly, and removed through said housing output end, each said baffle assembly comprising:

a perforated tube disposed along a segment of the axis of said housing and having an axially isolated input end within said housing and an output end, an input side baffle plate disposed transversely across the housing adjacent to the input end of said tube, said baffle providing a solid cover between said tube and said housing and having a central opening channeling input gas into said tube, and an output baffle plate disposed transversely across said housing adjacent to said tube output end, said output baffle plate having a plurality of apertures extending therethrough, whereby exhaust gas may be expelled.

* * * * *